US010950929B2

(12) United States Patent
Brigham

(10) Patent No.: US 10,950,929 B2
(45) Date of Patent: Mar. 16, 2021

(54) FOAM RADIATOR

(71) Applicant: Massachusetts Institute Of Technology, Cambridge, MA (US)

(72) Inventor: Glenn A. Brigham, Chelmsford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 633 days.

(21) Appl. No.: 15/648,620

(22) Filed: Jul. 13, 2017

(65) Prior Publication Data

US 2018/0048061 A1 Feb. 15, 2018

Related U.S. Application Data

(60) Provisional application No. 62/362,108, filed on Jul. 14, 2016.

(51) Int. Cl.

| | |
|---|---|
| ***H01Q 1/38*** | (2006.01) |
| ***H01Q 13/02*** | (2006.01) |
| ***H01Q 13/08*** | (2006.01) |
| ***H01Q 1/48*** | (2006.01) |

(52) U.S. Cl.

CPC ..... *H01Q 1/38* (2013.01); *H01Q 1/48* (2013.01); *H01Q 13/02* (2013.01); *H01Q 13/0283* (2013.01); *H01Q 13/085* (2013.01)

(58) Field of Classification Search

CPC ..... H01Q 1/38; H01Q 1/40; H01Q 13/085; H01Q 1/48

See application file for complete search history.

(56) References Cited

U.S. PATENT DOCUMENTS

| | | | | |
|---|---|---|---|---|
| 4,959,658 | A | 9/1990 | Collins | |
| 5,117,240 | A | 5/1992 | Anderson et al. | |
| 5,949,030 | A | 9/1999 | Fasano et al. | |
| 6,107,976 | A * | 8/2000 | Purinton | H01Q 1/42 343/872 |
| 7,057,570 | B2 * | 6/2006 | Irion, II | H01P 5/10 343/725 |

(Continued)

OTHER PUBLICATIONS

Panzer, Ben, "Development of an Electrically Small Vivaldi Antenna: The CReSIS Aerial Vivaldi (CAV-A)", 2004, University of Kansas. (Year: 2004).*

(Continued)

*Primary Examiner* — Dimary S Lopez Cruz
*Assistant Examiner* — Amal Patel
(74) *Attorney, Agent, or Firm* — Nields, Lemack & Frame, LLC

(57) ABSTRACT

A novel system and method for creating a lightweight antenna is disclosed. Each lightweight antenna is formed using a foam material. This foam material is coated with a machinable material, which is machined to the desired dimensions. The machinable material is then plated with a metal. This creates a radiator that has the size and performance of traditional notch antennas, but weighs far less. This foam radiator may be mounted to a variety of substrate types, not limited to microwave laminate materials. Embodiments of mixed substrates or even multi-layered foam substrates are possible. The substrate may be a conventional printed circuit board (PCB), a PCB with sleeved coaxial vias, or a foam substrate. The lightweight antenna may be used in a plurality of applications, including ultra-wideband array systems and space-based applications.

20 Claims, 12 Drawing Sheets

(56) References Cited

U.S. PATENT DOCUMENTS

| | | | | |
|---|---|---|---|---|
| 7,404,250 | B2 | 7/2008 | Cheng et al. | |
| 8,350,767 | B2 * | 1/2013 | Brigham | H01Q 13/106 342/44 |
| 8,502,085 | B2 | 8/2013 | Kim | |
| 9,635,761 | B2 | 4/2017 | Brigham et al. | |
| 10,249,943 | B2 | 4/2019 | Brigham | |
| 2004/0246191 | A1 | 12/2004 | Melconian et al. | |
| 2005/0247482 | A1 | 11/2005 | Nakamura | |
| 2006/0044083 | A1 | 3/2006 | Kuzmenka | |
| 2006/0256024 | A1 | 11/2006 | Collinson | |
| 2007/0124930 | A1 | 6/2007 | Cheng et al. | |
| 2007/0194431 | A1 | 8/2007 | Corisis et al. | |
| 2009/0066598 | A1 | 3/2009 | Malstrom et al. | |
| 2009/0294167 | A1 | 12/2009 | Nomiya | |
| 2009/0322636 | A1 | 12/2009 | Brigham et al. | |
| 2010/0195301 | A1 | 8/2010 | Fotherby | |
| 2011/0203842 | A1 | 8/2011 | Russell | |
| 2012/0012375 | A1 | 1/2012 | Song | |
| 2012/0175782 | A1 | 7/2012 | Im et al. | |
| 2013/0088406 | A1 | 4/2013 | Hamada et al. | |
| 2013/0105987 | A1 | 5/2013 | Gallegos et al. | |
| 2013/0318847 | A1 | 12/2013 | Kelly | |
| 2014/0306845 | A1 * | 10/2014 | Shiu | H01Q 1/38 343/700 MS |
| 2015/0014045 | A1 | 1/2015 | Brigham et al. | |
| 2015/0276459 | A1 | 10/2015 | Sai et al. | |
| 2017/0040678 | A1 | 2/2017 | Brigham | |
| 2017/0208695 | A1 | 7/2017 | Brigham et al. | |

OTHER PUBLICATIONS

International Search Report and Written Opinion dated Jan. 17, 2018 in corresponding PCT application No. PCT/US17/41837.

Office action dated Jan. 11, 2018 in co-pending U.S. Appl. No. 15/302,638.

Notice of allowance dated Mar. 28, 2019 in co-pending U.S. Appl. No. 15/459,383.

IEEE 2005 Electronic Components and Technology Conference, 2005, pp. 1378-1382, "A New Via Hole Structure of MLB (Multi-Layered Printed Circuit Board) for RF and High Speed Systems", Kim, et al.

IEEE Transactions on Components and Packaging Technologies, vol. 26, No. 2, Jun. 2003, pp. 483-489, "Characterization and Modeling of a New Via Structure in Multilayered Printed Circuit Boards", Kwon, et al.

Proceedings of the 37th European Microwave Conference, Oct. 2007, Munich, Germany, pp. 134-137, "Design and Optimization of Coax-to-Microstrip Transition and Through-Hole Signal Via on Multilayer Printed Circuit Boards", Nath, et al.

IEEE Transactions on Microwave Theory and Techniques, vol. 45, No. 10, Oct. 1997, pp. 1981-1985, "Coax Via—A Technique to Reduce Crosstalk and Enhance Impedance Match at Vias in High-Frequency Multilayer Packages Verified by FDTD and MoM Modeling", Pillai.

International Search Report and Written Opinion dated Dec. 16, 2014 in co-pending PCT application No. PCT/US14/46211.

International Search Report and Written Opinion dated Aug. 12, 2015 in co-pending PCT application No. PCT/US2015/025114.

International Preliminary Report on Patentability dated Dec. 20, 2016 in co-pending PCT application No. PCT/US2015/025114.

Final rejection dated Dec. 26, 2018 in co-pending U.S. Appl. No. 15/459,383.

Notice of allowance dated Oct. 31, 2018 in co-pending U.S. Appl. No. 15/302,638.

Office action dated Jun. 27, 2018 in co-pending U.S. Appl. No. 15/459,383.

* cited by examiner

FOAM RADIATOR

This application claims priority of U.S. Provisional Patent Application Ser. No. 62/362,108, filed Jul. 14, 2016, the disclosure of which is incorporated by reference in its entirety.

This invention was made with Government support under Contract No. FA8721-05-C-0002, awarded by the U.S. Air Force. The government has certain rights in the invention.

FIELD

This disclosure relates to notch, tapered, horn and flared slot radiating antennas, and more particularly to radiating antennas that are made using a foam or foam-like material.

BACKGROUND

Array antennas are used for a variety of different applications. Array antennas may be constructed using a plurality of three-dimensional (3D) antennas. In certain embodiments, the 3D antennas may comprise notch antenna elements. The term "notch antenna" is intended to include tapered and flared elements, such that the shape is not limited by this disclosure. Each notch antenna element includes an electrically conductive body, referred to as a notch radiator element, which has a slot. The slot separates the notch radiator element into two prongs. One of the prongs may be grounded while the other prong is energized by an RF signal. In general, the energized prong conveys energy from a feed port into free space or air, or visa-versa. The feed port may have a characteristic impedance relative to the system impedance for maximum power transfer. The propagating signal leaving the feed port, transitions to a low profile stripline feed located under the tuned gap between the energized prong and the other prong. This gap is optimized with other dimensions to result in wideband operation. The low profile stripline transmission line conveys energy into the notch slot and then into free space or air. The antenna feed port may convey energy to and from the antenna system at its characteristic impedance. Typically, the input port is external to the antenna stackup for connectivity to other system hardware. However, this port may be embedded within the stackup as an integral part of the system feed network. Between this port and the radiating element are a variety of possible architectures creating a characteristic impedance match over the desired operational frequency band.

These notch antennas may be combined to form ultra-wideband array systems. Ultra-wideband low loss phased array systems are desired in the cellular, telemetry and military applications. Use of this technology in these areas allow greater flexibility in achieving compact low cost higher power designs.

However, since, in this type of array, since there may be a large number of notch antennas, the weight of such arrayed radiators may become considerable since the radiators are an all metal structure.

Therefore, it would be beneficial if there were a notch antenna that had the same performance characteristics as traditional metal antennas, but weighed significantly less. Further, it would be advantageous if this system was also cost effective, robust and easy to manufacture.

SUMMARY

A novel system and method for creating a lightweight antenna is disclosed. Each lightweight antenna is formed using a foam material. This foam material is coated with a machinable material, which is machined to the desired dimensions. The machinable material is then plated with a metal. This creates a radiator that has the size and performance of traditional notch antennas, but weighs far less. This foam radiator may be mounted to a variety of substrate types, not limited to microwave laminate materials. Embodiments of mixed substrates or even multi-layered foam substrates are possible. The substrate may be a conventional printed circuit board (PCB), a PCB with sleeved coaxial vias, or a foam substrate. The lightweight antenna may be used in a plurality of applications, including ultra-wideband array systems and space-based applications.

According to one embodiment, an antenna system is disclosed. The antenna system comprises a foam radiator comprising an interior made of a foam material and a conductive exterior. In certain embodiments, the antenna system further comprises an intermediate layer disposed between the interior and the conductive exterior. In certain embodiment, the intermediate layer comprises a machinable material, which coats the foam material, and the conductive exterior comprises a metal plating.

According to another embodiment, a method of forming a foam radiator is disclosed. The method comprises forming a foam material in a basic shape of a desired antenna; coating the foam material with a machinable material; machining the machinable material to precise dimensions required by desired antenna; and plating the machinable material with a metal. In certain embodiments, the metal comprises nickel, copper or gold. In certain embodiments, the entirety of the foam material is coated with the machinable material.

According to another embodiment, an antenna system is disclosed. The antenna system comprises a foam radiator comprising an interior made of a foam material and a conductive exterior, wherein the foam radiator is formed as a flared, horn or notch antenna having a grounded prong and an energized prong separated by a slot; and a substrate on which the foam radiator is disposed. In certain embodiments, a ground plane is disposed on the top surface of the substrate in regions where the foam radiator is disposed. In certain embodiments, the substrate comprises a signal trace that traverses a region beneath the slot; an embedded ground plane; and a vertical space between the signal trace and the embedded ground plane. In certain embodiments, the substrate comprises at least three layers, wherein at least one of the layers comprises a foam material.

BRIEF DESCRIPTION OF THE DRAWINGS

For a better understanding of the present disclosure, reference is made to the accompanying drawings, which are incorporated herein by reference and in which.

DETAILED DESCRIPTION

The present disclosure describes a foam radiator which may be used as a notch, flared, horn or Vivaldi antenna. The foam radiator may be mounted to a variety of substrate types, not limited to microwave laminate materials. Embodiments of mixed substrates or even multi-layered foam substrates are possible. In some embodiments, the substrate is a traditional printed circuit board. However, in other embodiments, the substrate may comprise a foam material, further reducing the weight of the entire assembly.

Figure 1A:
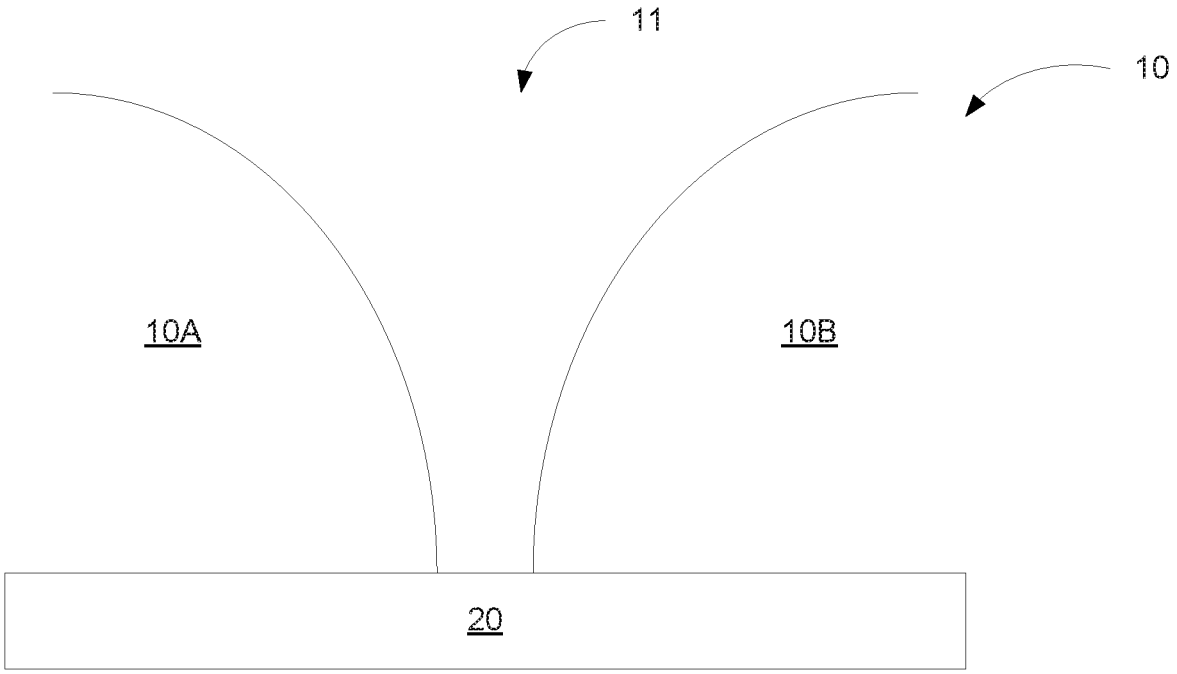
FIG. 1A shows a foam radiator according to a first embodiment.

FIG. 1A shows a foam radiator 10 mounted to a substrate 20 according to a first embodiment. In this embodiment, the foam radiator 10 is formed as a flared or Vivaldi antenna. The foam radiator 10 has a slot 11 that separates the foam radiator 10 into an energized prong 10B and a grounded prong 10A. The shape of the slot 11 is not limited by this disclosure and may be as shaped in FIG. 1A or may be any other shape.

Figure 1B:
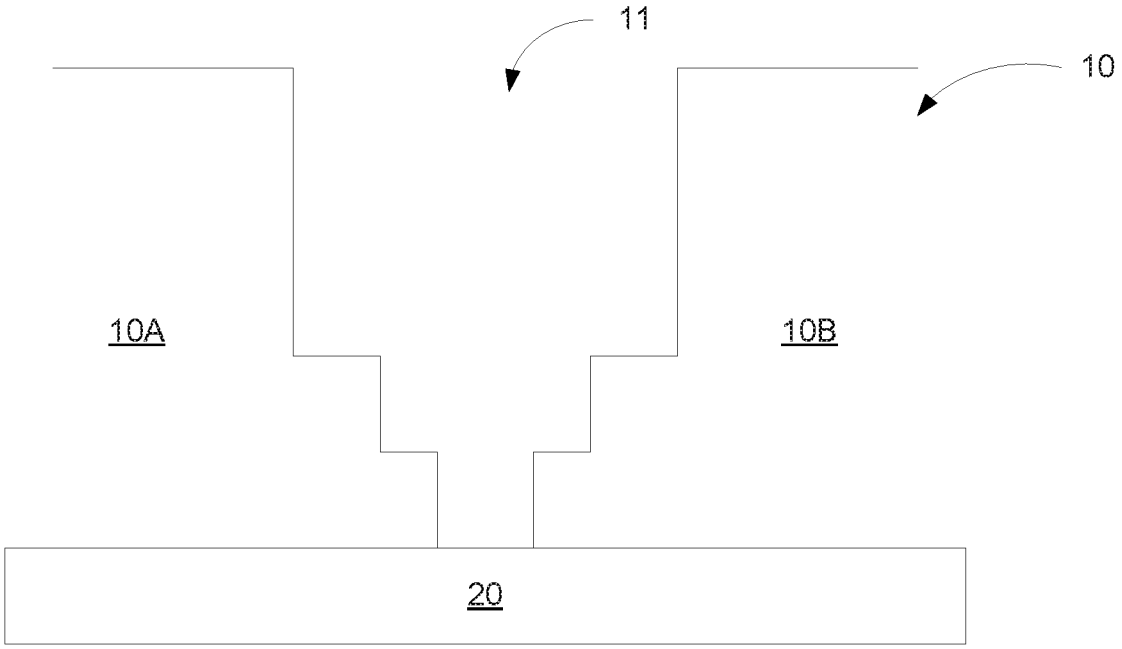
FIG. 1B shows a foam radiator according to a second embodiment.

FIG. 1B shows a foam radiator 10 mounted to a substrate 20 according to a second embodiment. In this embodiment, the foam radiator 10 is formed as a notch antenna. FIG. 1B shows the slot 11 as having three distinct steps, where the distance between the grounded prong 10A and the energized prong 10B is different for each step. However, the slot 11 may have any number of steps.

In both embodiments, the foam radiator 10 is mounted to a substrate 20. As described above, the substrate 20 may be a traditional printed circuit board, or may be a structure that includes a foam material.

Additionally, there is an attachment mechanism that attaches the substrate 20 to the foam radiator 10. In certain embodiments, this attachment mechanism may be a conductive adhesive that is disposed between the top surface of the substrate 20 and the bottom surface of the foam radiator 10.

Each component of the FIGS. 1A-1B will now be described in greater detail.

In certain embodiments, the foam radiator 10 may comprise three layers. The innermost layer, or interior, provides the basic shape and structure of the antenna. This innermost layer is a structural foam material, such as Rohacell®. This structural foam material is a material formed by trapping gas within a solid. This process may be used to create a material having open cells, which is defined as a material having 50% or more of the cells open, or connected to one another. Alternatively, this process may be used to create a material having closed cells, which refers to a material where at least 90% of the cells are discrete pockets of gas. In certain embodiments, the foam material has more than 50% gas. In certain embodiments, the foam material may have more than 75% gas. In certain embodiments, the foam material may have at least 90% gas. Further, the high ratio of gas to solid also affects other parameters of the foam material. For example, the density of the material may be less than 0.5 g/cc because of the large amount of gas. In certain embodiments, the density may be less than 0.1 g/cc. Additionally, because of the amount of gas in the foam material, its dielectric constant may approach that of air. For example, in certain embodiments, the dielectric constant of the foam material may be less than 2.0. In certain embodiments, the dielectric constant may be less than 1.5. In certain embodiments, the dielectric constant may be less than 1.25. In certain embodiments, the foam material may have a dielectric constant within 10% of that of air. In addition to the attributes of the foam material which result from its high gas content, the foam material may preferably have other properties. For example, the foam material may be strong enough to support drilling and other PCB processes. Also, the foam material may preferably have a high thermal temperature so that it can endure processing better, since some of the processes described herein use an elevated temperature.

Advantageously, the foam material may be over 150 times lighter than aluminum.

The foam material is then coated with a machinable material. This machinable material is selected so that it may be machined with fine precision. Further, the machinable material must be able of being plated. Any material that is capable of performing these functions may be used, including Taiyo UVHP-100 or another material. The machinable material is then plated with a metal.

Figure 2:
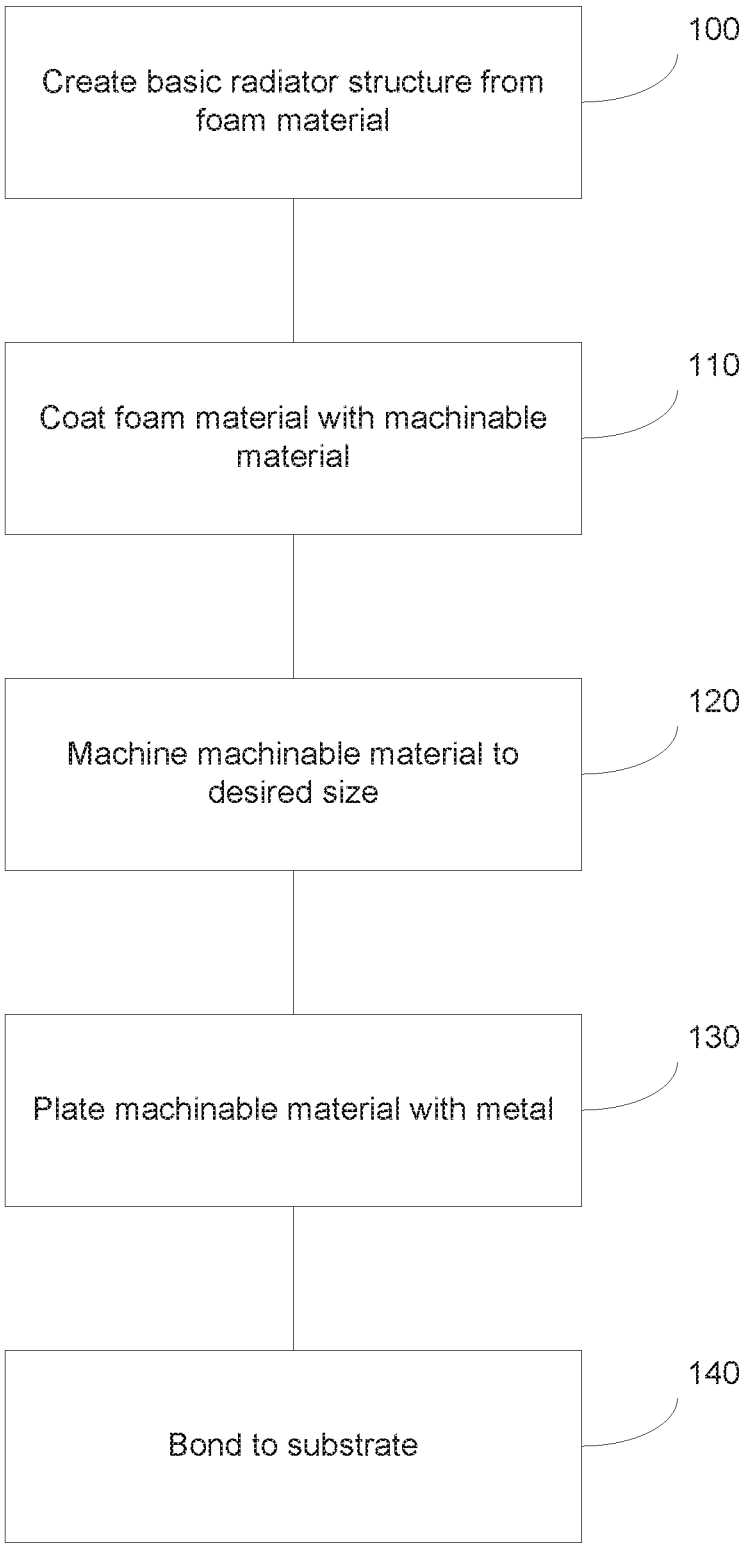
FIG. 2 shows a sequence that may be used to fabricate the foam radiator of FIGS. 1A-1B.
Figure 3B:
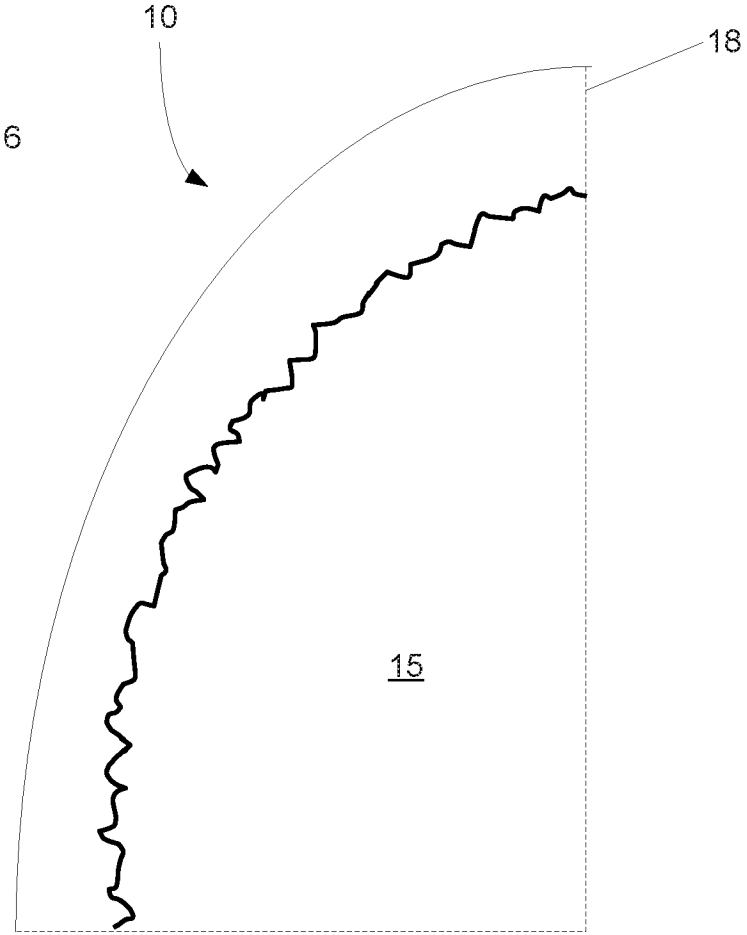
FIG. 3B shows a cross section of the foam radiator of FIG. 1A according to a second embodiment.
Figure 3A:
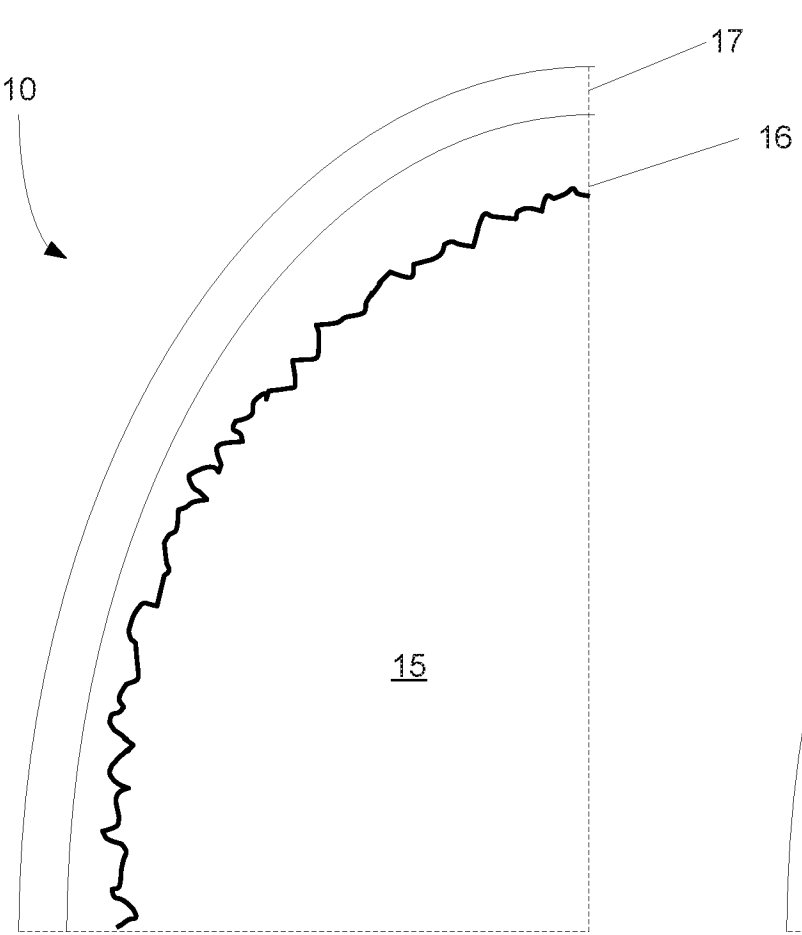
FIG. 3A shows a cross section of the foam radiator of FIG. 1A according to one embodiment.

FIG. 2 shows the process of creating the foam radiator 10. FIG. 3A shows a cross-section of the foam radiator 10 shown in FIG. 1A according to one embodiment. First, the foam material 15 is formed in the basic shape that is desired, as shown in Process 100. This may be done by machining, thermal forming or some other process. In certain embodiments, the part may be extruded or molded. Since the foam material 15 has high porosity, the outer surface may not be smooth. Thus, in some embodiments, the foam material 15 is formed in a shape and size that is somewhat smaller than the desired final size. FIGS. 3A-3B show an exaggerated view of the jaggedness of the foam material 15. In some embodiments, the dimensions of the slot 11 are a function of the wavelength of the signal to be transmitted. Thus, higher frequency signals have very small wavelengths and very precise tolerances on the dimensions of the slot 11. For example, the dimensional tolerance of the slot 11 may be required to be within 12.5 um. This tolerance may increase or decrease depending on frequency band, bandwidth and scan volume desired for a required input impedance match. Since the foam material 15 cannot be machined to this level of precision, it is coated with a machinable material 16, as shown in Process 110. As described above, the machinable material 16 is capable of being machined, and is capable of being plated. This machinable material 16 coats the entirety of the foam material 15. It is then machined to the precise dimensions required by the particular application, as shown in Process 120. Note that, as shown in FIG. 3A, the machinable material 16 compensates for the surface roughness of the foam material 15, such that the outer surface of the machinable material 16 can be machined to precisely reflect the desired shape. Specifically, the outer surface of the machinable material 16 may be the desired size minus the plating thickness. After machining, the machinable material 16 is plated with a metal 17, as shown in Process 130. This metal 17 may be nickel, copper, gold or any other suitable metal or other conductive material. After the plating operation, the foam radiator 10 is complete. It now has the desired shape and dimensions and is completely covered by a conductive metal. It can now be bonded to a substrate, as shown in Process 140. The foam radiator 10 may be bonded to the substrate using a pressure sensitive adhesive (PSA), a conductive adhesive, such as CF3350, COOLSPAN TECA or a similar material, or a conductive or non-conductive paste. The foam radiator 10 may be bonded using, for example, a PSA, an epoxy film adhesive, an epoxy paste adhesive, a cyanate ester paste adhesive or a cyanate ester film adhesive.

FIG. 3B shows the foam radiator 10 according to another embodiment. In this embodiment, a machinable conductive material 18 is employed. As an example, materials such as LOCTITE® EDAG 1415M and 503 may be used. Of course, other materials that are both machinable and conductive, may be used. Because this material is both machinable and conductive, there is no need to apply a separate machinable material 16 and metal 17. Thus, Process 130 of FIG. 2 may be omitted in this embodiment, since the machinable conductive material 18 does not need to be plated. In this embodiment, the machinable conductive material 18 is machined to the precise dimensions of the desired size.

In yet another embodiment, the configuration shown in FIG. 3B may be used with an additional primer layer. For example, the primer layer may be used simply to coat the foam material 15. The machinable conductive material 18 may then be disposed on the primer layer. This embodiment may be used if the machinable conductive material 18 is caustic to the foam material 15.

In certain embodiments, an additional primer layer may be used with the configuration shown in FIG. 3A. In such an embodiment, the primer layer is disposed between the foam material 15 and the machinable material 16.

Thus, in both embodiments, the foam radiator 10 comprises an interior constructed of a foam material that is surrounded by a conductive outer surface, which may be metal. In the embodiment of FIG. 3A, an intermediate layer made of a machinable material 16 may be disposed between the foam interior and the conductive exterior. In the embodiment of FIG. 3B, the conductive outer surface is applied directly to the foam interior.

Having described the foam radiator 10, the description of suitable substrates will follow.

Figure 4:
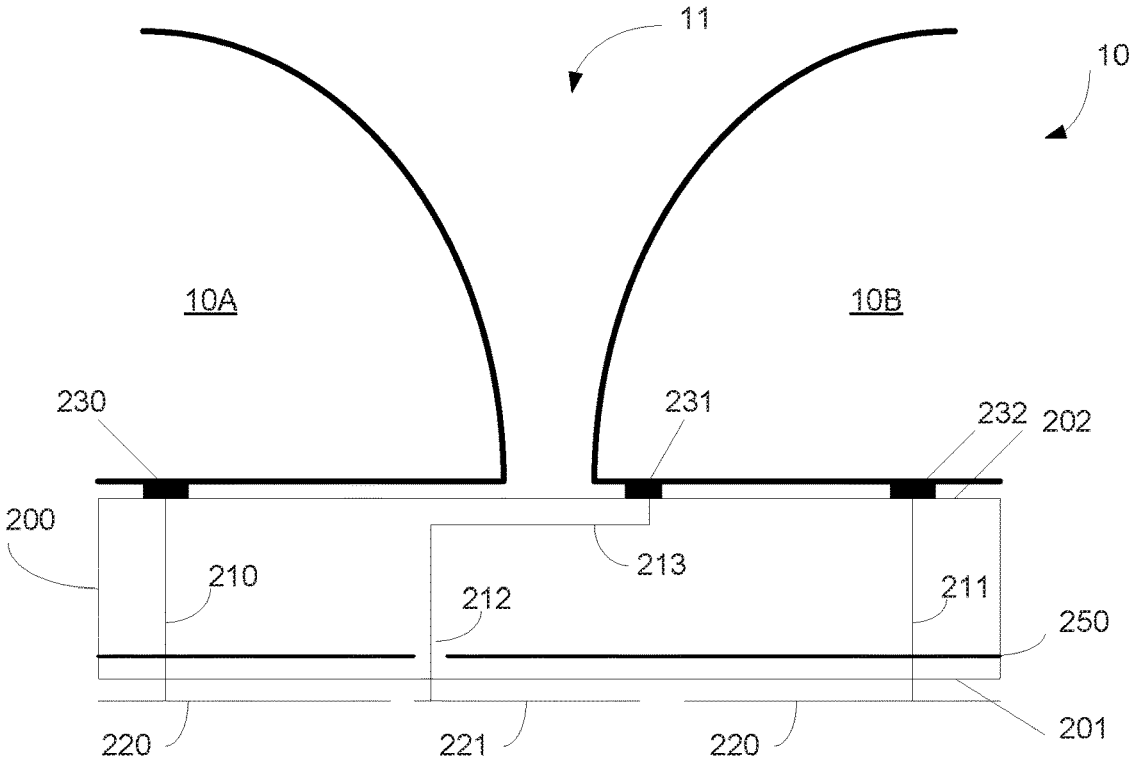
FIG. 4 shows the foam radiator mounted to a printed circuit board.

FIG. 4 shows the foam radiator 10 mounted to a traditional printed circuit board (PCB) 200. The spacing between the foam radiator 10 and the PCB 200 is exaggerated to better illustrate the system. Similarly, the traces on the bottom surface 201 of the PCB 200 are spaced from the bottom surface 201 for clarity. The PCB 200 may have a plurality of layers. Further, the PCB 200 may have a plurality of vias that extend from the bottom surface 201 of the PCB 200 to the top surface 202 of the PCB 200. In some embodiments, these vias extend through an entirety of the PCB 200, such as vias 210, 211. In certain embodiments, the vias may be hidden or blind vias, such as via 212.

The foam radiator 10 is grounded. In this embodiment, the via 210 is used to connect a ground plane 220 to one or more connection points 230 on the top surface 202. An embedded ground plane 250 may extend across an entirety of the PCB 200. An opening is formed in the embedded ground plane 250 to allow the via 212 to pass from the top surface 202 to the bottom surface 201.

In certain embodiments, a ground plane may be formed on the top surface 202 of the PCB 200 in all locations where the foam radiator 10 will be disposed. In this embodiment, the ground plane does not extend in the area that defines the slot 11.

Via 211 is used to connect ground plane 220 to one or more connection points 232. Vias 210, 211 also connect ground plane 220 to embedded ground plane 250. Conductive adhesive may be used to structurally and electrically connect the connection points 230, 232 to the foam radiator 10. In certain embodiments, a non-conductive adhesive or pressure sensitive adhesive may be used to structurally connect the top surface 202 to the foam radiator 10. This non-conductive adhesive would have a relief at the connections points so that it does not cover the connection points 230, 232, which must be electrically connected to the foam radiator 10 using some other conductive means such as a conductive paste or adhesive. The grounded prong 10A and the energized prong 10B are grounded using vias 210, 211, respectively.

An RF signal passes through a signal trace 221. As stated above, in certain embodiments, a ground plane is disposed beneath the signal trace 221. For example, embedded ground plane 250 may extend beneath signal trace 221. An opening is formed in the embedded ground plane 250 to allow the signal trace 221 to connect to connection point 231. This signal trace 221 is electrically connected to a connection point 231 on the top surface 202 using via 212, which includes an embedded signal trace 213. As noted above, via 212 may be a blind via, a hidden via or a traditional via. In certain embodiments, the embedded signal trace 213 travels beneath the slot 11 and parallel to the top surface 202 to enable efficient coupling of the RF signal to be transmitted from the foam radiator 10. This connection point 231 may electrically connected to the energized prong 10B using a conductive adhesive. This connection point 231 is preferably beneath the energized prong 10B near the slot 11. This embodiment uses separate vias 210, 211 to supply ground to the foam radiator 10. However, other embodiments are also possible.

In some embodiments, alignment holes may be used to align the foam radiator 10 and the substrate. In certain embodiments, the alignment holes are also used to align the various layers that comprises the substrate.

Figure 5:
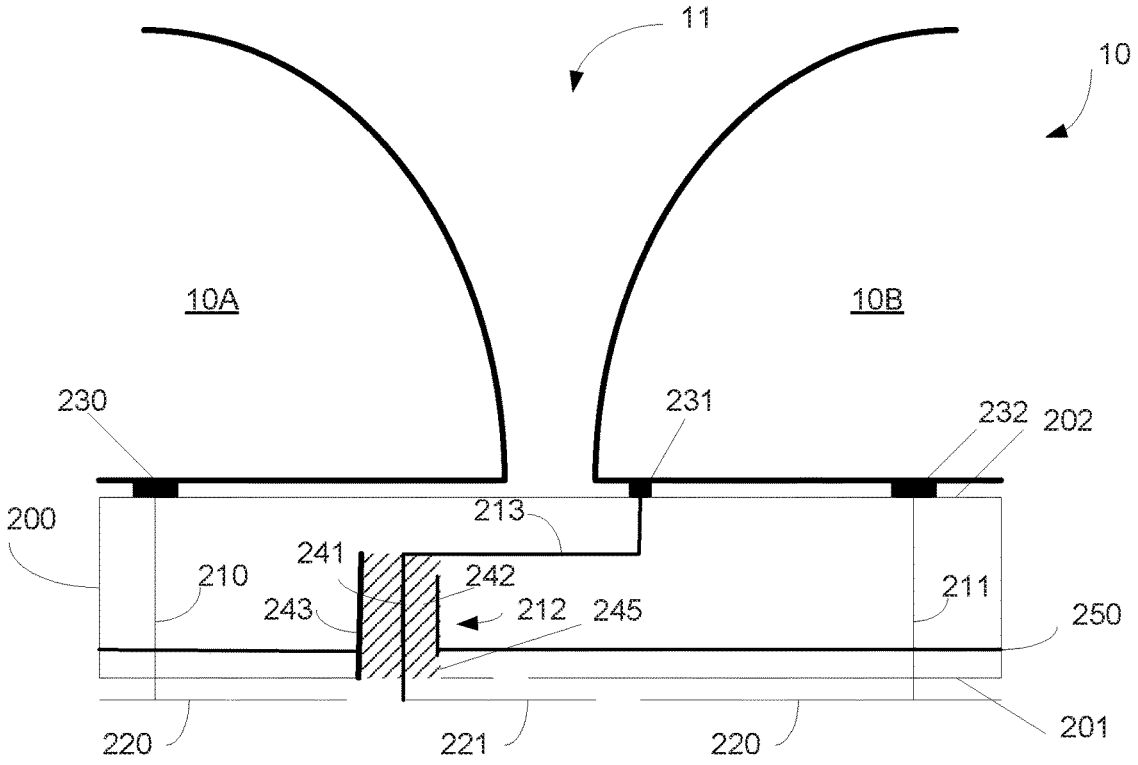
FIG. 5 shows the foam radiator mounted to a printed circuit board having a sleeved coaxial via.

As shown in FIG. 5, in certain embodiments, the via 212 may be a sleeved coaxial via. A sleeved coaxial via has a center conductive trace 241 which is surrounded by a dielectric material 242. The dielectric material 242 is then surrounded by a conductive outer sleeve 243. The conductive outer sleeve 243 may be connected to the ground plane 220. The conductive outer sleeve 243 may also be connected to the embedded ground plane 250 and connection point 230 or other connection point that is connected to ground. A notch 245 may be created in the conductive outer sleeve 243 to allow the signal trace 221 to connect to the center conductive trace 241. This configuration may provide added isolation and or more precise coaxial impedance and may allow higher signal transmission performance for the RF signal that is travelling through the center conductive trace 241. As described above with respect to FIG. 4, in certain embodiments, the embedded signal trace 213 travels beneath the slot 11 and parallel to the top surface 202 to enable efficient coupling of the RF signal to be transmitted from the foam radiator 10. Also, electrical traces or a patterned ground plane may be formed on the top surface 202 and bottom surface 201 of the PCB 200. In certain embodiments, the electrical traces may be a metalized footprint of the foam radiator in the top metal layer leaving the gap and via points open. The conductive bonding layer may be a 'preform' made from the CF3350 or similar material. A preform is a resulting laser or die cut image or some other cut method of the area that needs to make connectivity between the foam radiator 10 and PCB 200. This material may be 4 mils thick or another thickness depending on the design. The other components of FIG. 5 are identical to those shown in FIG. 4 and are not described again.

Thus, FIGS. 4-5 illustrate a substrate which comprises a PCB 200. The electrical connections from the PCB 200 to the foam radiator 10 may be made using traditional vias, as shown in FIG. 4, or using sleeved coaxial vias, as shown in FIG. 5.

Figure 6:
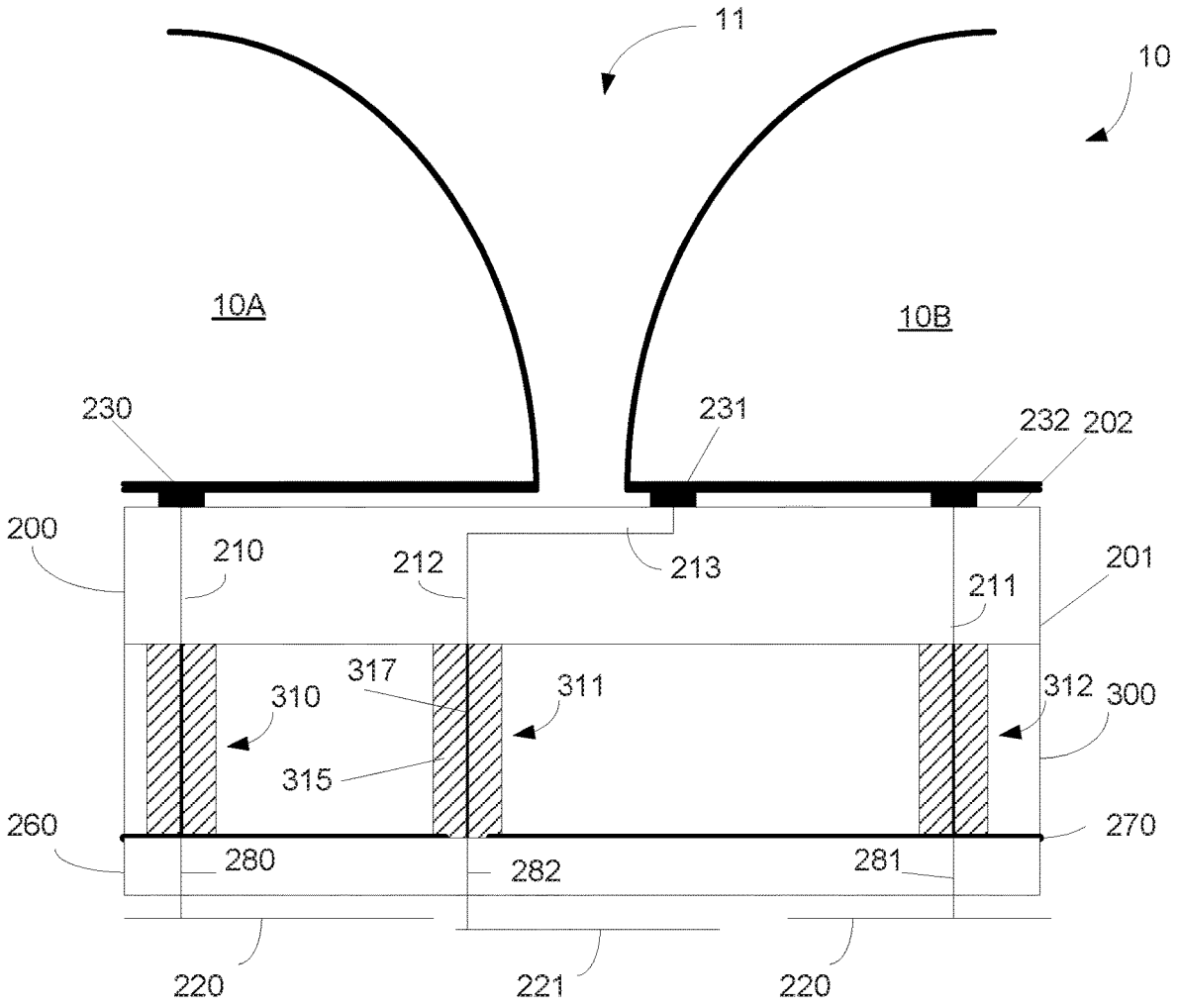
FIG. 6 shows the foam radiator mounted to a printed circuit board, which is mounted on a foam layer.

FIG. 6 shows the foam radiator 10 mounted to a different substrate. In this embodiment, the substrate includes a PCB 200, similar to that shown in FIG. 4, a foam layer 300, and a second PCB 260. The foam layer 300 may be constructed from the same material as the foam radiator 10, and may have the same properties as that material. In other embodiments, the foam layer 300 may be made from a different material than the foam radiator 10. The PCB 200 is disposed between the foam layer 300 and the foam radiator 10. The PCB 260 is disposed on the opposite side of the foam layer 300. The foam layer 300 has three through vias 310, 311, 312. Vias 310, 312 electrically connect the vias 210, 211, to vias 280, 281, respectively. Via 311 connects via 212 to via 282. A ground plane 270 may extend along the entirety of the top surface of the PCB 260. This ground plane 270 may have an opening in it to allow via 282 to connect to via 311. In other embodiments, the ground plane 270 may be a copper foil that is applied to the bottom surface of the foam layer 300.

To create the vias 310, 311, 312, within the foam layer 300, the following procedure may be used. First, a hole is drilled through the foam layer 300. This hole is then filled with a dielectric material 315, such as Taiyo UVHP-100 or an equivalent. Another material having suitable performance may also be used. The dielectric material 315 is used to fill the open cells in the foam layer 300, thereby providing a smooth post machined surface on which to plate. After the dielectric material 315 has filled the hole, the foam layer 300 may be planarized to insure that the dielectric material 315 is at the correct height.

The PCB 200 is then bonded to the top surface of the foam layer 300. The PCB 260 is then bonded to the bottom surface of the foam layer 300. The bonding agent may be a pressure sensitive adhesive, a low temperature adhesive or any other suitable agent and it may be conductive or non-conductive depending on design. The PCB 200, PCB 260 and the foam layer 300 may be baked under pressure with or without vacuum to cure the bond layers. In some embodiments, the edges of the foam layer 300 may be sealed at this time as well. To seal the edges, a coating may be applied before or in a separate process after the baking process. In this embodiment, the bonding agent and sealant coating may or may not be conductive.

After the PCB 200, PCB 260 and the foam layer 300 have been bonded together, a second hole is then drilled through or partially through this assembly. This second hole has a smaller diameter than the one drilled earlier, and is drilled through the dielectric material 315. In some embodiments, the first hole and the second hole are concentric. Thus, the second hole goes through the PCB 260, the foam layer 300 and at least part of the PCB 200.

The holes that connect ground plane 220 to the connection point 230, 232 are drilled through the entirety of the stack. The hole that creates vias 282, 311 and 212 may also be drilled through the entirety of the stack and then plated. At this point, a back drilling operation is conducted to remove the extended top via stub left over from the via plating process. This via may be removed to near flush relation with the embedded signal trace 213 or to some alternate height permitting acceptable radiator performance. As an optional drilling process to create these vias 282, 311 and 212, a controlled depth drilling process may be conducted, stopping the hole depth just after penetration of embedded signal trace 213. The hole is then plated and filled to create a central conductor 317.

In one embodiment, top and bottom artwork for PCB 260 is patterned prior to the bonding of PCB 260. If signal trace 221 and ground planes 220 are not patterned prior to bonding PCB 260 then they may be created at this time using techniques known in the art.

As described above, conductive adhesive may be used to structurally and electrically connect the connection points 230, 232 to the foam radiator 10. In certain embodiments, a non-conductive adhesive or pressure sensitive adhesive may be used to structurally connect the top surface 202 to the foam radiator 10. This non-conductive adhesive would have a relief at the connections points so that it does not cover the connection points 230, 232, which must be electrically connected to the foam radiator 10 by some means of conductive medium. The grounded prong 10A and the energized prong 10B are grounded using vias 210, 211, respectively. The connection point 231 may electrically connected to the energized prong 10B using a conductive adhesive or some other conductive medium. This connection point 231 is preferably beneath the energized prong 10B near the slot 11. Also, electrical traces or a patterned ground plane may be formed on the top surface 202 and bottom surface 201 of the PCB 200, 260. In certain embodiments, the electrical traces may be a metalized footprint of the foam radiator in the top metal layer leaving the gap and via points open. The conductive bonding layer maybe a 'preform' made from the CF3350 or similar material. A preform is a resulting laser or die cut image or some other cut method of the area that needs to make connectivity between the radiator and PCB. This material may be 4 mils thick or another thickness depending on the design.

The bonding agent used to attach the optional copper foil to the bottom surface of the foam layer 300 and may be conductive or non-conductive, and may be a pressure sensitive adhesive or a low temperature adhesive. The choice of bonding agent is a design specific implementation and is not limited by this disclosure. Copper foil may be used in any embodiment described herein.

Thus, FIG. 6 shows three layers, which each perform a specific function. The PCB 200 is used to allow the embedded signal trace 213 to traverse the region beneath the slot 11. The foam layer 300 is used to provide vertical spacing between the foam radiator and the ground plane 270. PCB 260 is used to provide ground plane 270 and the signal trace 221 and ground planes 220 on the outer surface so that they may be electrically attached to a connector or other connection means.

While FIG. 6 shows three distinct layers, it is noted that the PCB 200 of FIGS. 4 and 5 also perform all three of these functions. In other words, while three separate layers are used in some embodiments, in other embodiments one layer may perform two or more of these functions.

Figure 7:
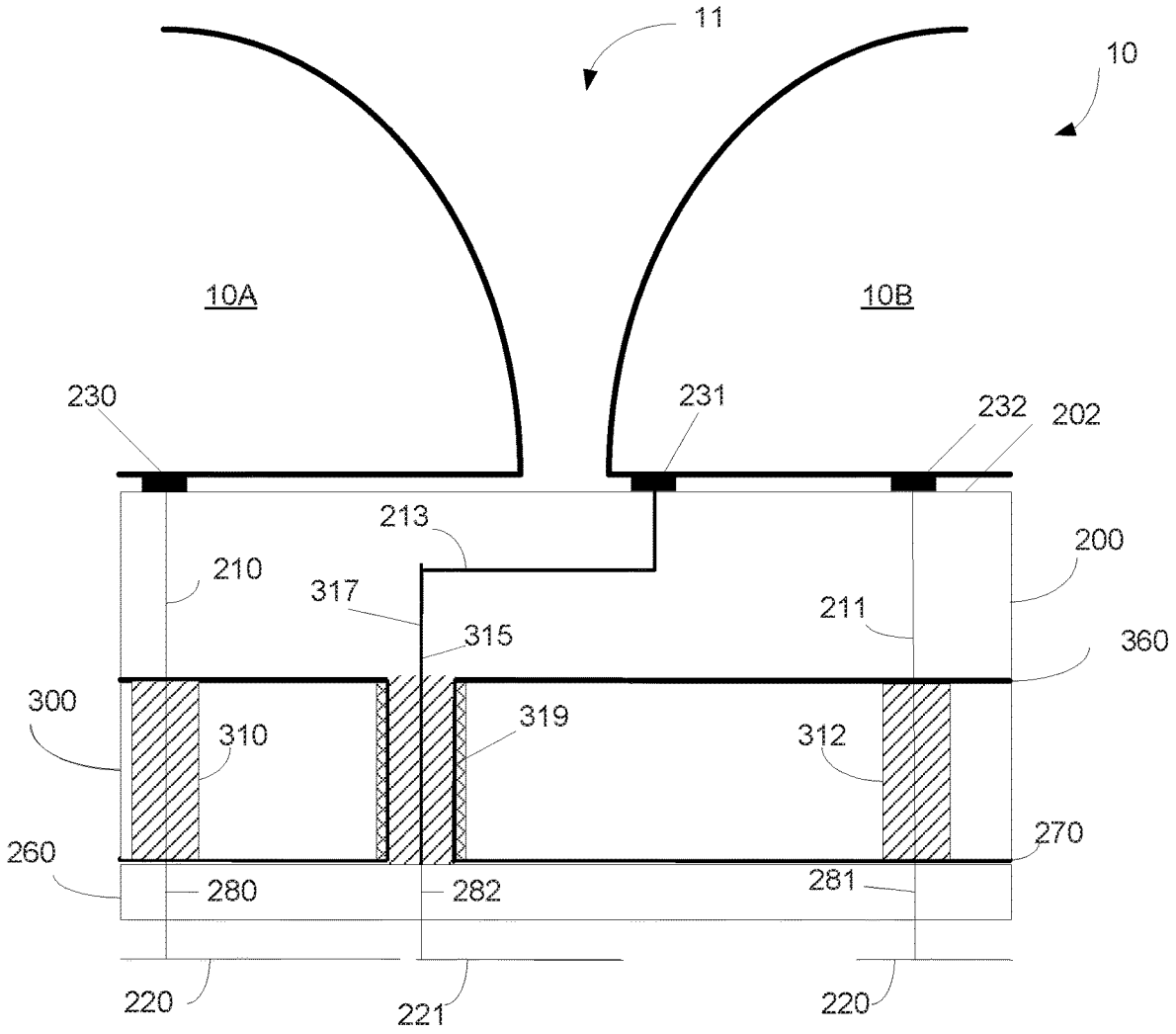
FIG. 7 shows the foam radiator mounted to a printed circuit board, which is mounted on a foam layer having a sleeved coaxial via.

FIG. 7 shows another embodiment which utilizes a PCB 260, a foam layer 300 and a PCB 200. In this embodiment, a sleeved coaxial via 350 is created in the foam layer 300.

This sleeved coaxial via 350 may be formed using the following procedure. Because embedded signal trace 213 exists, the PCB 200 may be a multiple layer board. Like the embodiment of FIG. 6, the PCB 260 may have a ground plane 270 on its top surface and signal trace 221 and ground plane 220 on its bottom surface.

In some embodiments, the foam layer 300 is first cleaned. The foam layer 300 may then be baked. Exposure to high temperature may cause the foam layer 300 to shrink. Note that the baking of the foam layer 300 may be performed for any of the embodiments described herein. After the foam layer 300 has been prepared, a hole is drilled through the foam layer 300. This hole is then filled with a dielectric material 315, such as Taiyo UVHP-100 or an equivalent. As explained above, the dielectric material 315 is used to fill the open cells in the foam layer 300, thereby providing a smooth machined surface on which to plate. After the dielectric material 315 has filled the hole, the foam layer 300 may be planarized to insure that the dielectric material 315 is at the correct height. Additionally, in some embodiments, alignment holes may also be drilled into the foam layer 300. Note that the use of alignment holes may be employed in any embodiment that utilizes more than one layer or type of material. Alignment holes may be drilled in the PCB 200 and the PCB 260 to allow registration during the assembly process.

Next, a copper foil 360 may be bonded to the top surface of the foam layer 300. Another copper foil may be bonded to the bottom surface of the foam layer 300. The bonding agent used to attach the copper foil 350 to the foam layer 300 may be conductive or non-conductive, and may be a pressure sensitive adhesive or a low temperature adhesive. The choice of bonding agent is a design specific implementation and is not limited by this disclosure. Copper foil 360 may be used in any embodiment described herein. Further, in certain embodiments, copper may be applied to the top and/or bottom surfaces of the foam layer 300 using the sealing and plating method described above.

In other embodiments, the bottom surface of the PCB 200 and the top surface of the PCB 260 may be ground planes. In this way, it may not be necessary to bond copper foil to the foam layer 300. This embodiment may cause the drilling operation of the sleeve to be more complicated. In either embodiment, one or more embedded ground planes may be included in the assembly. These embedded ground planes may be at the boundary between the foam layer 300 and the PCB 200 and at the boundary between the foam layer 300 and the PCB 260.

Next, a second hole is drilled through the foam layer 300. This second hole is aligned with the dielectric material 315 previously used to fill a hole in the foam layer 300. This second hole has a smaller outer diameter than the first hole drilled through the foam layer 300, and is preferably concentric with that larger diameter hole. As such, there is dielectric material 315 surrounding the second hole.

The second hole is then plated with a metallic material to create an annular metal sleeve 319. The metallic material may be a metal, such as copper. The second hole is then filled with dielectric material 315 again, which is then planarized at the bottom surface of the foam layer 300. Thus, at this time, there is an annular metal sleeve 319 running through the thickness of the foam layer 300. Dielectric material 315 is disposed on both sides of this annular metal sleeve 319 in the foam layer 300.

At this point, the PCB 200 and the PCB 260 may be bonded to opposite sides of the foam layer 300. There are a variety of methods that can be used to do this. A third hole is then drilled through at least a portion of the PCB 200, the PCB 260 and foam layer 300. This third hole has a smaller outer diameter than the second hole and is preferably concentric with the first and second holes. This third hole may also be drilled through the entirety of the stack and then plated. At this point, a back drilling operation may be conducted to remove the extended top via stub left over from the via plating process. This via may be removed to near flush relation with the embedded signal trace 213 or to some alternate height permitting acceptable radiator performance. As an optional drilling process to create these vias, a controlled depth drilling process may be conducted stopping the hole depth just after penetration of embedded signal trace 213. The hole is then plated and filled to create a central conductor 317. At this point, the annular metal sleeve 319 is electrically attached to ground planes disposed on both sides of the foam layer 300. As stated above, these ground planes may be surfaces of the abutting PCBs or may be copper foil.

Signal trace 221 is then formed on the bottom surface of the PCB 260 and is in electrical communication with the central conductor 317. The ground plane 220 may be connected to one or more embedded ground planes and the bottom of the foam radiator 10 using vias 210, 211. In another embodiment, these vias are not used through the foam layer 300, relying instead on electrical communication between ground plane 220 on bottom surface of PCB 260 and the embedded ground planes and the annular metal sleeve 319.

The foam radiator 10 may be electrically connected to connection points 230, 231, 232 in the same manner as described in FIG. 5.

Thus, FIGS. 6-7 illustrate a substrate which comprises a PCB 200, a PCB 260 and a foam layer 300, where the PCB 200 is disposed between the foam radiator 10 and the foam layer 300, and the PCB 260 is disposed on the opposite side of the foam layer 300. The electrical connections, referred to as signal vias as in this case of communicating a signal between signal trace 221 and foam radiator 10, may be made using traditional vias, as shown in FIG. 6, or using sleeved coaxial vias, as shown in FIG. 7.

Figure 8A:
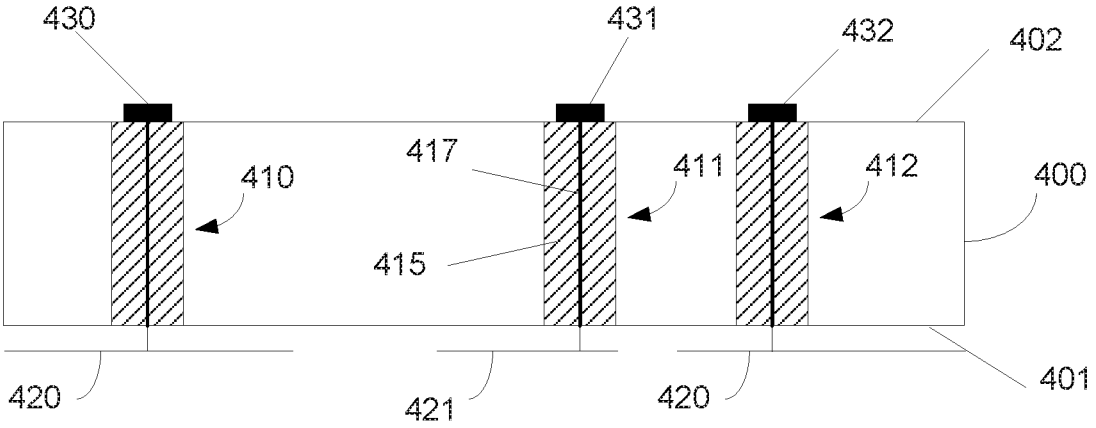
FIG. 8A-8B shows a single foam layer according to two embodiments.
Figure 8B:
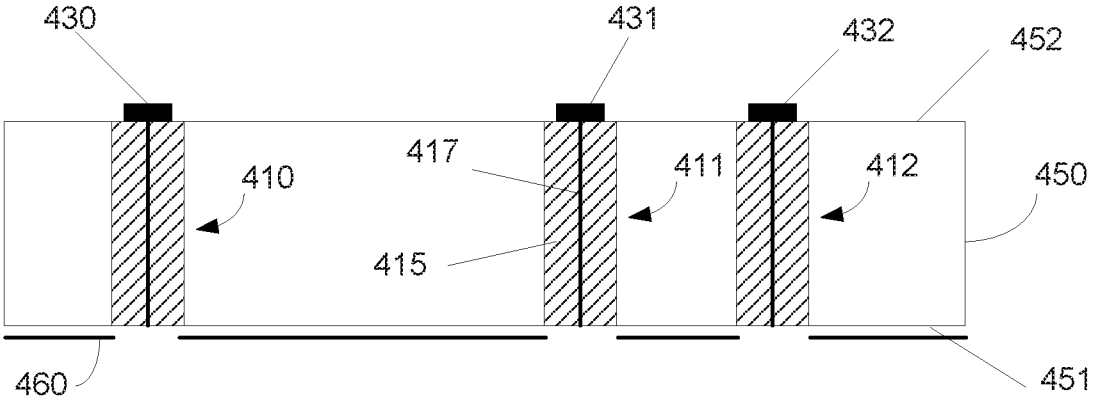

FIGS. 6-7 show the use of a foam layer as part of the substrate. The following provides a more detailed description of how a foam layer may be fabricated. FIG. 8A shows a foam layer 400 having a plurality of vias 410, 411, 412 extending therethrough. The foam layer 400 also comprises a ground plane 420 and a signal trace 421 disposed on the bottom surface 401 and connection points 430, 431, 432 disposed on the top surface 402. FIG. 8B shows a foam layer 450. In this embodiment, the foam layer 450 includes a top surface 452 and a copper foil 460 disposed on the bottom surface 451.

FIGS. 8A-8B are intended to show the variety of geometries that can be formed on the top and bottom surfaces of the foam layer. For example, connection points 430, 431, 432 may be formed on the top and/or bottom surface of a foam layer. Similarly, signal traces 421 and ground planes 420 may be formed on the top and/or bottom surface of a foam layer. Additionally, a copper foil 460 may be disposed on the top and/or bottom surface of a foam layer. These three geometries allow foam layers to be stacked together to form any desired configuration. Other combinations of signal traces and/or via geometries can be fabricated as are known in the art. Consequently, all combinations are not listed herein.

Figure 9:
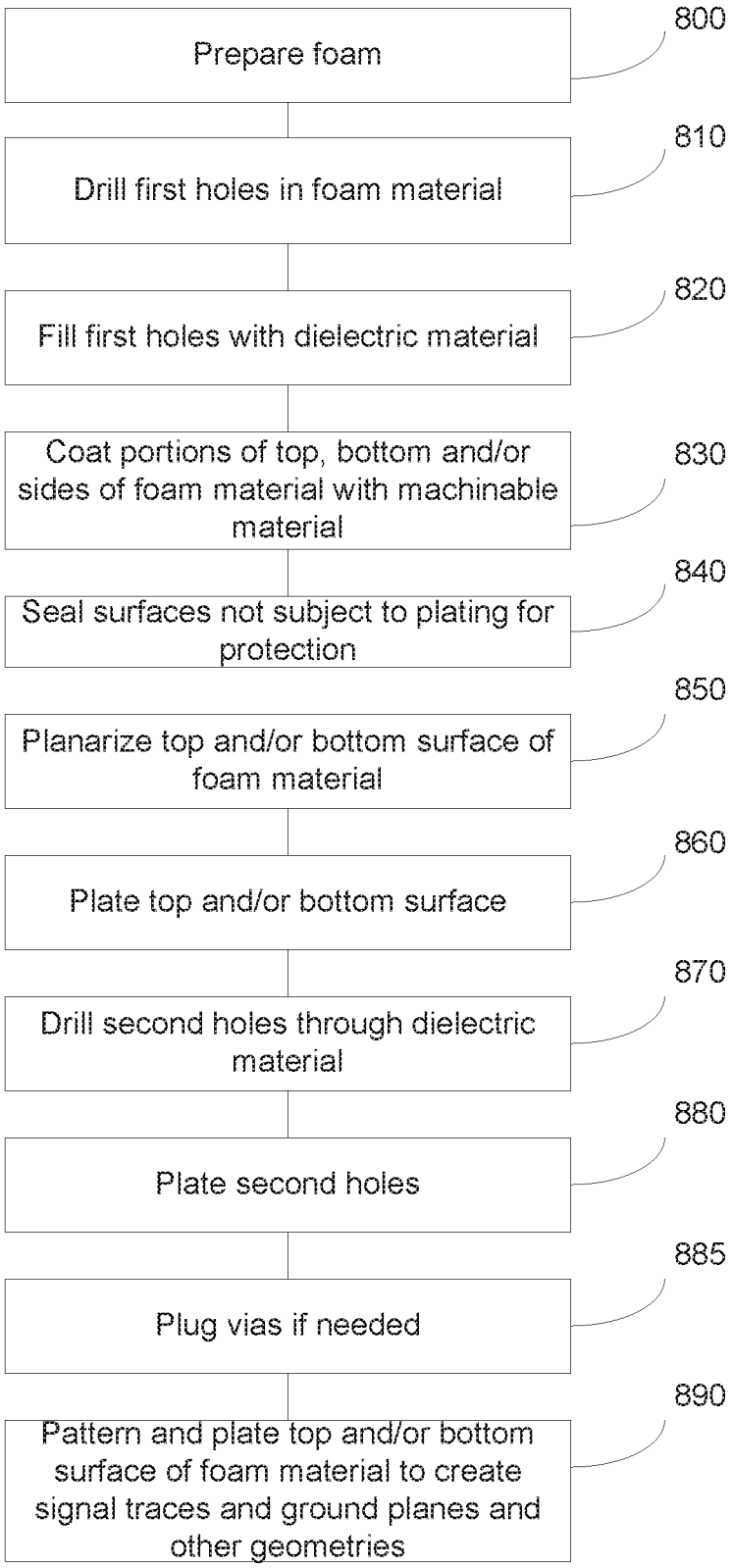
FIG. 9 shows a sequence that may be used to fabricate the foam radiator of FIG. 8.

FIG. 9 shows the sequence to produce the foam layer 400 shown in FIG. 8A. First, as shown in Process 800, the foam is prepared. This may include baking and cleaning the foam material. Next, as shown in Process 810, first holes, which are intended to form vias 410, 411, 412 are drilled through the foam material. These first holes are then filled with the dielectric material 415, as shown in Process 820. Alignment holes may be drilled along with the first via holes setting a fixed orientation and alignment reference datum. These alignment holes may or may not be plated by following the plating process depending on design. The top surface 402, the bottom surface 401 and optionally the side surfaces may be coated with the machinable material, as shown in Process 830 if they are to be plated. Any surface that will not be plated may be sealed for protection, as shown in Process 840. The top surface 402 and bottom surface 401 of the foam layer 400 may optionally be planarized, as shown in Process 850. Thus, at this point, machinable material covers the foam material at each location that metal plating will occupy. The top and/or bottom surfaces of the foam material, as well as optionally on the sides, are plated, as shown in Process 860. Next, second holes are drilled through the dielectric material, as shown in Process 870. These second holes may be concentric with the first holes and are a smaller diameter. Next, the second holes are plated as shown in Process 880. This operation forms the center conductors 417 for the vias 410, 411, 412. Next, vias are plugged if needed, as shown in Process 885. Next, the bottom surface 401 and/or top surface 402 of the foam material is patterned and plated to form the signal trace 421 and the ground plane 420, as shown in Process 890. In certain embodiments, top surface 402 may be plated near the center conductors 417 to form the connection points 430, 431, 432.

The foam layer 450 shown in FIG. 8B may be fabricated in a similar fashion. However, rather than plating the bottom surface 451 (see Process 860), a copper foil 460 may be bonded to this bottom surface 451. This creates a ground plane. In certain embodiments, it is not necessary to coat the bottom surface 451 (see Process 830) when a copper foil is going to be bonded to that surface.

Figure 10:
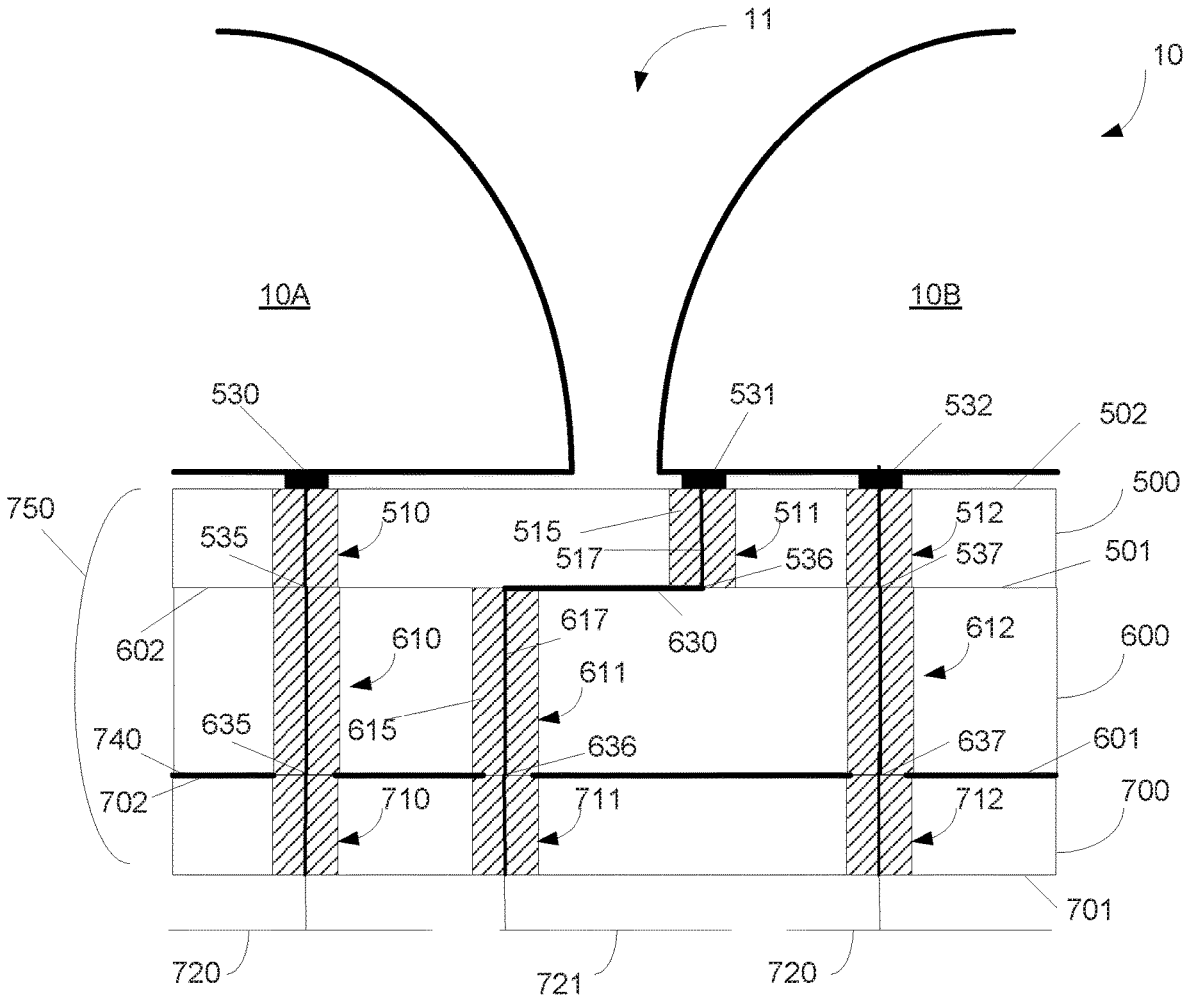
FIG. 10 shows the foam radiator mounted on a multi-layer foam circuit board.

FIG. 8A-8B show foam layers 400, 450 that may be used in the embodiments shown in FIGS. 6-7. However, other embodiments are also possible. FIG. 10 shows a multi-layer foam circuit board 750 formed from a first foam layer 500 and a second foam layer 600 and third foam layer 700. While three foam layers are shown, it is understood that this multi-layer foam circuit board may have any number of layers. It is also understood that any combination of foam and other laminate can be created but not discussed here.

The multi-layer foam circuit board 750 includes through vias, such as the one represented by vias 510, 610, 710 and by vias 512, 612, 712. The multi-layer foam circuit board 750 may also include blind vias, such as the one represented by vias 511, 611, 711. As is well known, a blind via is a via that connects one outer layer to an inner layer, but does not extend through the circuit board. Furthermore, though not shown, multi-layer foam circuit board 750 may also include buried vias. Buried vias are vias that connect two inner layers but do not extend to either outer layer. FIG. 10 also shows the dielectric material 515, 615, and center conductors 517, 617.

According to one embodiment, the multi-layer foam circuit board 750 may be manufactured by fabricating first foam layer 500, second foam layer 600 and third foam layer 700 in accordance with the process shown in FIG. 9. In this embodiment, each via may need a pad to provide a connection point to the corresponding via on the adjacent foam layer. In other words, the first foam layer 500 is fabricated according to the process in FIG. 9 and has a top surface 502 with three connection points 530, 531, 532. The bottom surface 501 of the first foam layer 500 also has three connection points 535, 536, 537. Similarly, the second foam layer 600 is fabricated using the process shown in FIG. 9. During the fabrication of second foam layer 600, a signal trace 630 is deposited on the top surface 602 of the second foam layer 600. This signal trace 630 extends from the top of via 611 to the location where connection point 536 will contact the top surface 602 when the two foam layers are attached to one another. Alternatively, this signal trace 630 may be deposited on the bottom surface 501 of first foam layer 500. Additionally, connection points 635, 636 and 637 may be formed on the bottom surface 601 of the second foam layer 600. The top surface 702 of third foam layer 700 may be bonded to a copper foil 740. An opening is made in the copper foil 740 so that connection point 636 is not connected to the copper foil 740. In a different embodiment, the top surface 702 is coated and plated to form a plated ground plane on the top surface 702. On the bottom surface 701, signal trace 721 and ground planes 720 are formed.

After all foam layers are fabricated, they may be attached to one another. A conductive adhesive is applied to the connection points 535, 536 and 537. When the first foam layer 500 is placed on top of the second foam layer 600, via 610 is electrically connected to via 510, via 612 is electrically connected to via 512 and via 611 is electrically connected to via 511. When the second foam layer 600 is placed on top of the third foam layer 700, via 610 is electrically connected to via 710, via 612 is electrically connected to via 712 and via 611 is electrically connected to via 711. Thus, in this embodiment, each foam layer is assembled and then bonded with conductive adhesive. No post bonding drilling or plated may be needed.

Figure 11:
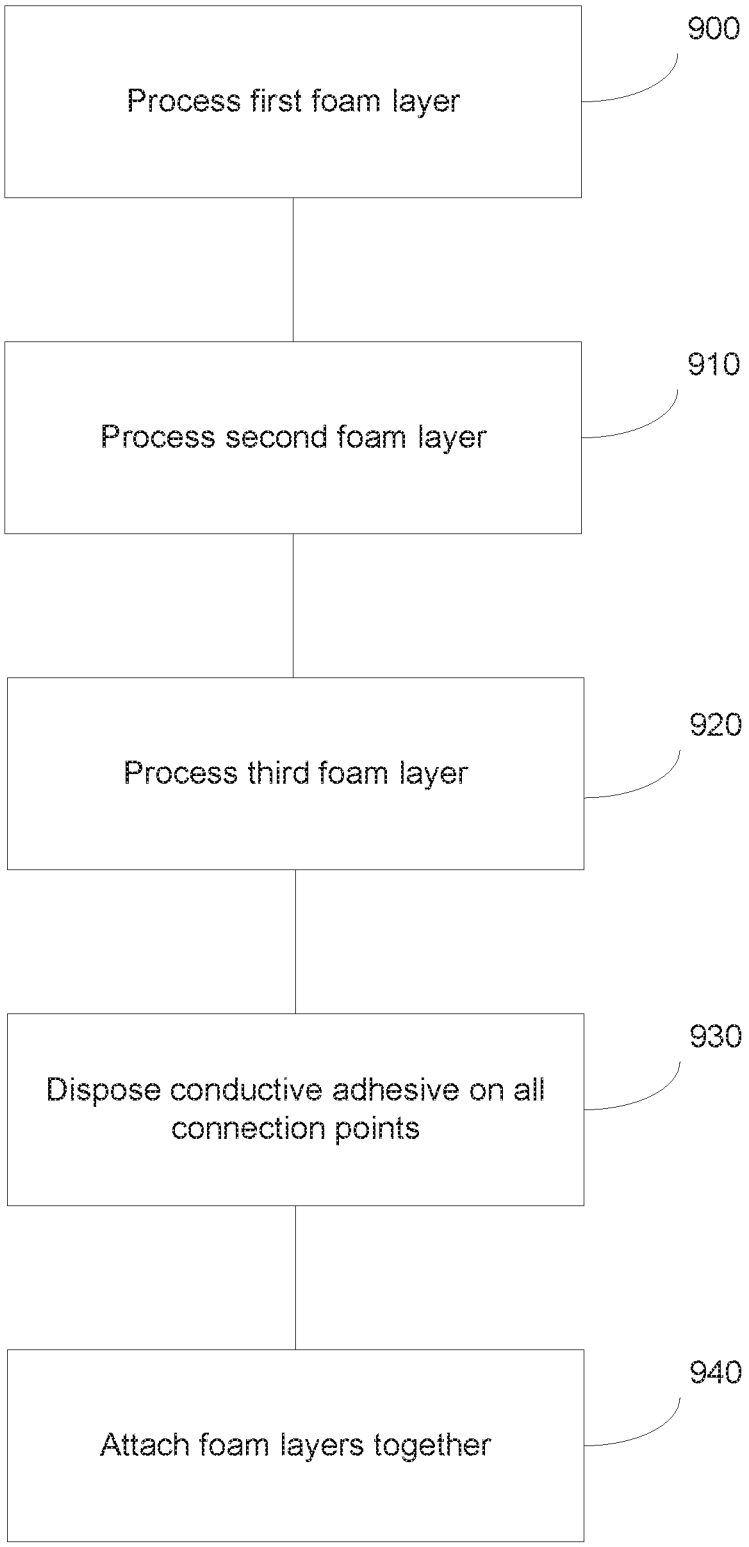
FIG. 11 illustrates a sequence that may be used to fabricate the multi-layer foam circuit board of FIG. 10 according to one embodiment.

The process of manufacturing a multi-layer foam circuit board according to this embodiment is shown in FIG. 11. As described above, the first foam layer 500 is processed in accordance with the sequence shown in FIG. 9, as shown in Process 900. This includes adding signal traces and/or ground planes on the top surface 502 and the bottom surface 501. The second foam layer 600 is then processed in accordance with the sequence shown in FIG. 9, as shown in Process 910. The third foam layer 700 is then processed in accordance with the sequence shown in FIG. 9, as shown in Process 920. Note that the order of Process 900, Process 910 and Process 920 is not important, the second foam layer 600 or the third foam layer 700 may be processed before or simultaneous with the processing of the first foam layer 500. When these processes are completed, the top surface 502 of the first foam layer 500 may have a plurality of connection points which will be used to attach to the foam radiator 10. The bottom surface 501 of the first foam layer 500 may also have a plurality of connection points that are intended to connect to corresponding connection points on the top surface 602 of the second foam layer 600. The bottom surface 601 of the second foam layer 600 may also have a plurality of connection points that are intended to connect to corresponding connection points on the top surface 702 of the third foam layer 700. The bottom surface 701 of the third foam layer 700 may have signal traces and/or ground planes. Conductive material, such as a conductive adhesive is then disposed on the connection points on the bottom surface 501 of the first foam layer 500 and/or the top surface 602 of the second foam layer 600. Additionally, conductive material is also disposed on the connection points on the bottom surface 601 of the second foam layer 600 and/or the top surface 702 of the third foam layer 700, as shown in Process 930. The three foam layers are then attached, as shown in Process 940.

The connection points on the bottom surface 501 of the first foam layer 500 align with the connection points on the top surface 602 of the second foam layer 600 and an electrical connection is made between corresponding connection points. Similarly, the connection points on the bottom surface 601 of the second foam layer 600 align with the connection points on the top surface 702 of the third foam layer 700 and an electrical connection is made between corresponding connection points. At completion, the connection points on the top surface 502 of the first foam layer 500 align with the metalized regions on the bottom surface of foam radiator 10.

FIG. 11 shows one approach that may be used to fabricate the multi-layer foam circuit board 750 shown in FIG. 10. However, other approaches may be used.

Figure 12:
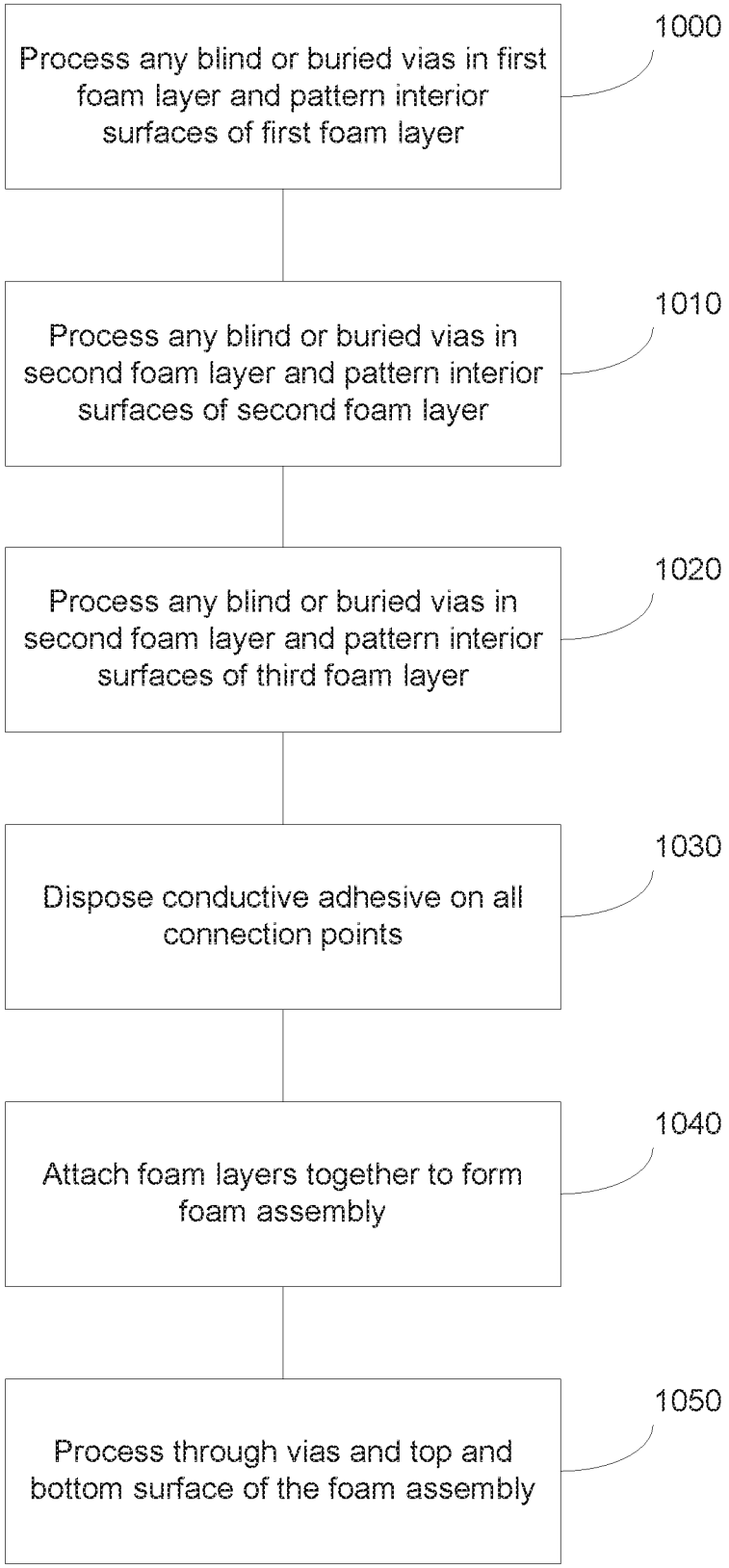
FIG. 12 illustrates a sequence that may be used to fabricate the multi-layer foam circuit board of FIG. 10 according to another embodiment.

FIG. 12 illustrates the fabrication process of the multi-layer foam circuit board 750 according to another embodiment. As explained above, the multi-layer foam circuit board 750 may have through vias, blind vias and buried vias. Through vias are those that extend through all of the layers of the multi-layer foam circuit board 750. Consequently, these through vias may be added after the foam layers 500, 600, 700 have been attached to one another. Similarly, the outer surfaces of the multi-layer foam circuit board 750 may be processed after the foam layers have been attached to one another and may be processed after plated holes are created.

Thus, in this embodiment, the first foam layer 500 is processed in accordance with the process of FIG. 9, as shown in Process 1000. This processing includes drilling alignment holes. However, rather than drilling all vias and processing both surfaces of the first foam layer 500, only the blind and buried vias are processed. For example, in FIG. 10, only via 511 will be created in Process 1000. Also, both surfaces of the first foam layer 500 do not have to be processed at this time. Thus, in certain embodiments, only the bottom surface 501 of the first foam layer 500, which will become an interior surface, is processed in Process 1000. Thus, after Process 1000, the first foam layer 500 will include the via 511 and at least one connection point on the bottom surface 501 where the via 511 terminates. The second foam layer 600 is similarly processed, as shown in Process 1010. This processing includes drilling alignment holes. In this embodiment, the second foam layer 600 will include via 611 and the signal trace 630. The bottom surface 601 of the second foam layer 600 is also processed at this time and at least one connection point 636 is created, since the other connection points may be on the ground plane. The third foam layer 700 is similarly processed, as shown in Process 1020. This processing includes drilling alignment holes. In this embodiment, the third foam layer 700 will include via 711 and a connection point to connect to connection point 636. The bottom surface 701 of the third foam layer 700 need not be processed at this time. Next, as shown in Process 1030, conductive material, such as conductive adhesive is applied to the connection points on the bottom surface 501 of the first foam layer 500, and/or the top surface 602 of the second foam layer 600, and/or the bottom surface 601 of the second foam layer 600 and/or the top surface 702 of the third foam layer 700. These layers are then attached to one another to create the foam assembly, as shown in Process 1040. At this point, as shown in Process 1050, the foam assembly may be processed in accordance with FIG. 9. Specifically, any through vias, such as vias 510,610,710 and vias 512,612,712, can be formed using the sequence shown in Processes 800-850 in FIG. 9. Once the through vias have been created, the top surface 502 and the bottom surface 701 may be patterned and plated as required. Thus, connection points 530, 531, 532 may be added to top surface 502. Likewise, signal trace 721 and ground plane 720 may be added to the bottom surface 701 at this time.

It is noted that the fabrication process described above may be altered. For example, the second foam layer 600 and the third foam layer 700 may be bonded together to form a foam subassembly, prior to the formation of vias 611, 711 since, with respect to these two foam layers, this via is a through via. After this via is created, the first foam layer 500 may be bonded to the foam subassembly. Vias 510,610,710 and 512,612,712 are then created.

Figure 13:
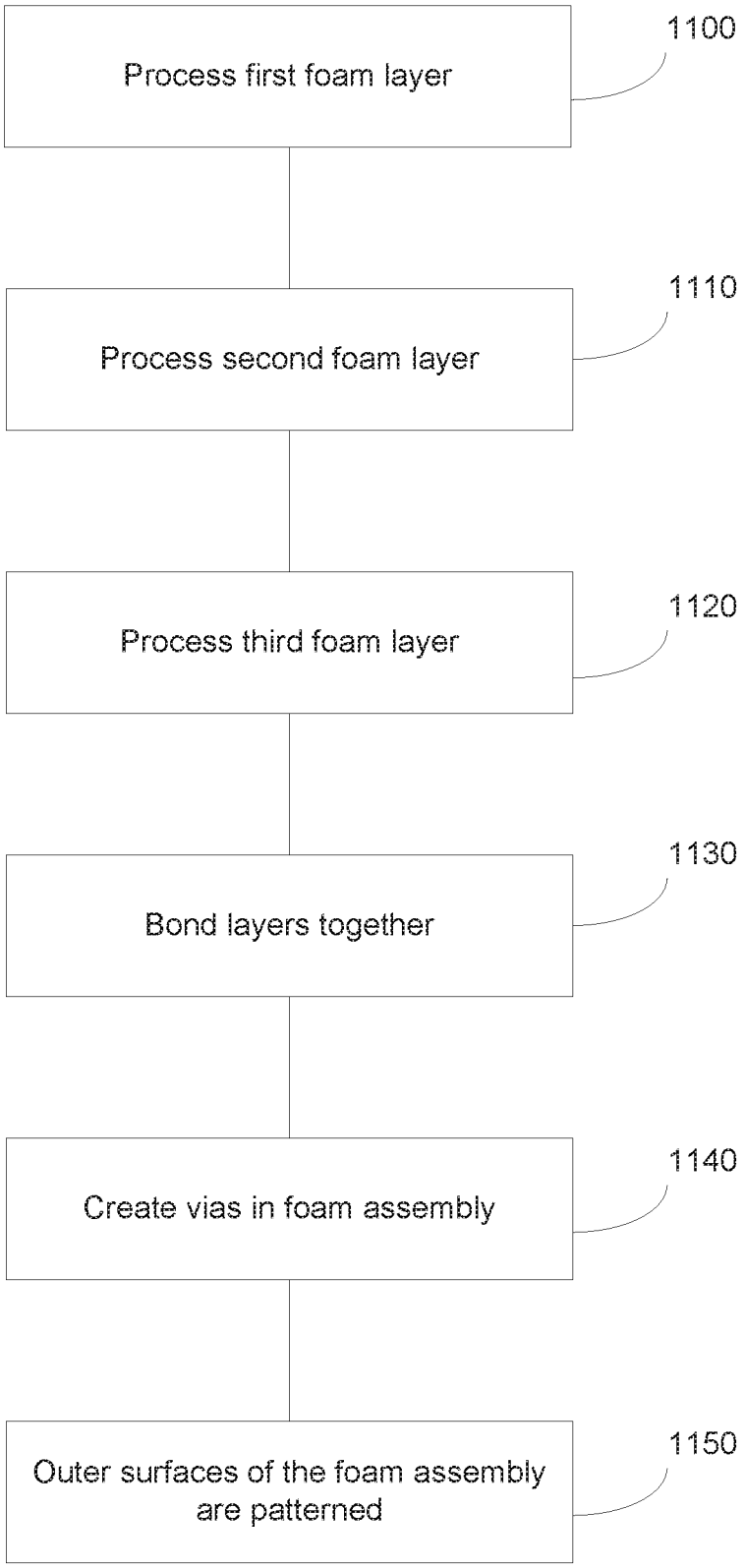
FIG. 13 illustrates a sequence that may be used to fabricate the multi-layer foam circuit board of FIG. 10 according to another embodiment.

FIG. 13 illustrates the fabrication process of the multi-layer foam circuit board 750 according to another embodiment.

In Process 1100, the first foam layer 500 is processed. This processing includes drilling alignment holes and the first holes through the first foam layer 500. The first holes are then filled and the surfaces are planarized. The top surface 502 is then plated to form a patterned ground plane. Thus, referring to FIG. 9, Processes 800-850 are performed. Additionally, Processes 860 and 890 is performed for the top surface 502.

In Process 1110, the second foam layer 600 is processed. This processing includes drilling alignment holes and the first holes through the second foam layer 600. The first holes are then filled and the surfaces are planarized. The top surface 602 is then plated and patterned to form signal trace 630 and a ground plane. Thus, again, referring to FIG. 9, Processes 800-850 are performed. Additionally, Processes 860 and 890 is performed for the top surface 602.

In Process 1120, the third foam layer 700 is processed. This processing includes drilling alignment holes and the first holes through the third foam layer 700. The first holes are then filled and the surfaces are planarized. The top surface 702 and bottom surface 701 are then plated. Thus, again, referring to FIG. 9, Processes 800-850 are performed. Additionally, Processes 860 and 890 is performed for the both surfaces.

In Process 1130, the first foam layer 500, the second foam layer 600 and the third foam layer 700 are bonded together. This may be done using a conductive or non-conductive adhesive, as described above.

In Process 1140, the vias are created in the foam assembly. Specifically, second holes are drilled through the foam assembly to form vias 510,610,710 and vias 512,612,712. A second hole is also drilled through a portion of the foam assembly using a controlled depth drilling to form via 611, 711 and via 511. Thus, referring to FIG. 9, Processes 870-890 are performed at this time.

In Process 1150, the outer surfaces of the foam assembly, namely top surface 502 and bottom surface 701 are patterned. Referring again to FIG. 9, Process 890 is performed on the top outer surfaces at this time. After completion, the foam assembly is now the multi-layer foam circuit board 750.

The foam radiator 10 may then be aligned to the multi-layer foam circuit board 750 using alignment holes in the foam radiator 10 and multi-layer foam circuit board 750 and then bonded to the top surface 502 using conductive adhesive.

It is noted that while FIG. 10 shows traditional vias, the vias in the multi-layer foam circuit board can also be sleeved coaxial vias, as described in FIG. 7. These sleeved coaxial vias can be created as described above.

While the above disclosure describes one configuration, other configurations are also possible. For example, the signal trace 630 may be formed on the bottom surface 501 of the first foam layer 500 or on the top surface 602 of the second foam layer 600. The embedded ground plane 740 may be formed on the bottom surface 601 of the second foam layer 600 or the top surface 702 of the third foam layer 700. The embedded ground plane 740 may be a copper foil or may be plated on one of the surfaces.

Thus, this multi-layer foam circuit board 750 performs the three functions described earlier. Signal trace 630 passes beneath the slot 11. An embedded ground plane 740 is formed. Signal traces 721 and ground planes 720 are available for connection to other systems.

FIG. 6 shows a three layer stack formed with two PCBs and one foam layer, while FIG. 10 shows a three layer stack formed with three foam layers. However, it is also understood that the three layer stack may comprise two foam layers and one PCB. For example, referring to FIG. 6, either PCB 200 or PCB 260 may be replaced with a foam layer, such as those shown in FIGS. 8A-8B.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An antenna system, comprising:

a foam radiator comprising an interior made of a foam material, and a conductive exterior wherein the foam radiator is formed as a flared, horn or notch antenna having a grounded prong and an energized prong separated by a slot; and a substrate on which the foam radiator is disposed, wherein the substrate comprises at least three layers, wherein at least one of the layers comprises a foam material and at least one of the layers comprises a printed circuit board, and wherein the substrate comprises:

a signal trace that traverses a region beneath the slot;

an embedded ground plane; and a vertical space between the signal trace and the embedded ground plane.

2. The antenna system of claim 1, wherein the foam material comprises Rohacell®.

3. The antenna system of claim 1, wherein the foam material has a density of less than 0.5 g/cc.

4. The antenna system of claim 1, wherein the conductive exterior comprises a metal plating.

5. The antenna system of claim 1, wherein a ground plane is disposed on a top surface of the substrate in regions where the foam radiator is disposed.

6. The antenna system of claim 1, wherein the foam radiator is disposed on the printed circuit board that comprises the signal trace; and the printed circuit board is disposed on a foam layer.

7. The antenna system of claim 1, wherein the vertical space is provided by a foam layer, and the printed circuit board is disposed on a bottom surface of the foam layer, wherein the embedded ground plane is disposed in the printed circuit board.

8. The antenna system of claim 1, further comprising an intermediate layer disposed between the interior and the conductive exterior, wherein the intermediate layer comprises a machinable material, which coats the foam material.

9. An antenna system, comprising:

a foam radiator comprising an interior made of a foam material and a conductive exterior, wherein the foam radiator is formed as a flared, horn or notch antenna having a grounded prong and an energized prong separated by a slot; and a substrate on which the foam radiator is disposed, wherein the substrate comprises:

a signal trace that traverses a region beneath the slot;

an embedded ground plane; and a vertical space between the signal trace and the embedded ground plane;

wherein the substrate comprises at least three layers and wherein at least two of the at least three layers comprise foam layers and wherein the foam radiator is disposed on a first foam layer; the first foam layer is disposed on a second foam layer; and the signal trace is formed on a bottom surface of the first foam layer or on a top surface of the second foam layer.

10. The antenna system of claim 9, wherein the foam material comprises Rohacell®.

11. The antenna system of claim 9, wherein the foam material has a density of less than 0.5 g/cc.

12. The antenna system of claim 9, wherein a ground plane is disposed on a top surface of the substrate in regions where the foam radiator is disposed.

13. The antenna system of claim 9, further comprising an intermediate layer disposed between the interior and the conductive exterior, wherein the intermediate layer comprises a machinable material, which coats the foam material.

14. An antenna system, comprising:

a foam radiator comprising an interior made of a foam material and a conductive exterior, wherein the foam radiator is formed as a flared, horn or notch antenna having a grounded prong and an energized prong separated by a slot; and a substrate on which the foam radiator is disposed, wherein the substrate comprises:

a signal trace that traverses a region beneath the slot;

an embedded ground plane; and a vertical space between the signal trace and the embedded ground plane;

wherein the substrate comprises at least three layers and wherein at least two of the at least three layers comprise foam layers and wherein the vertical space is provided by a first foam layer, and a second foam layer is disposed on a bottom surface of the first foam layer, wherein the embedded ground plane is disposed between the first foam layer and the second foam layer.

15. The antenna system of claim 14, wherein the embedded ground plane comprises a copper foil.

16. The antenna system of claim 14, wherein a top surface of the second foam layer or a top surface of the first foam layer is plated to form the embedded ground plane.

17. The antenna system of claim 14, wherein the foam material comprises Rohacell®.

18. The antenna system of claim 14, wherein the foam material has a density of less than 0.5 g/cc.

19. The antenna system of claim 14, wherein a ground plane is disposed on a top surface of the substrate in regions where the foam radiator is disposed.

20. The antenna system of claim 14, further comprising an intermediate layer disposed between the interior and the conductive exterior, wherein the intermediate layer comprises a machinable material, which coats the foam material.

* * * * *